166-274 SR
FIP7912 XR 4,007,787

United States Patent [19]
Cottle

[11] 4,007,787
[45] Feb. 15, 1977

[54] GAS RECOVERY FROM HYDRATE RESERVOIRS

[75] Inventor: John E. Cottle, Bartlesville, Okla.
[73] Assignee: Phillips Petroleum Company, Bartlesville, Okla.

[22] Filed: Aug. 18, 1975
[21] Appl. No.: 605,709
[52] U.S. Cl. ..... 166/267; 166/271; 166/272; 166/274; 166/305 R
[51] Int. Cl.² ..... E21B 43/16
[58] Field of Search ..... 166/248, 267, 272, 274, 166/279, 303, 304, 305, DIG. 1, 305 R, 271, 266; 252/8.3, 8.55 B

[56] References Cited

UNITED STATES PATENTS

| | | | |
|---|---|---|---|
| 3,348,614 | 10/1967 | Sinclair et al. | 166/310 |
| 3,372,753 | 3/1968 | Tuttle | 166/314 |
| 3,627,047 | 12/1971 | Wilson et al. | 166/DIG. 1 |
| 3,762,474 | 10/1973 | Allen et al. | 166/305 R |
| 3,878,892 | 4/1975 | Allen et al. | 166/274 |
| 3,920,072 | 11/1975 | Kern | 166/248 |

FOREIGN PATENTS OR APPLICATIONS

| | | | |
|---|---|---|---|
| 612,901 | 1/1961 | Canada | 166/310 |

OTHER PUBLICATIONS

Withers et al., "Glycol Injection Solves Canadian Gas-Gathering Problem," Oil's Gas Journal, Feb. 6, 1967, pp. 81–86.

*Primary Examiner*—Ernest R. Purser

[57] ABSTRACT

Natural gas is recovered from gas hydrate reservoirs by passing light hydrocarbons, which do not form hydrates at reservoir conditions, through the formation to dissolve and recover the natural gas. A freezing point depressant can also be injected into the reservoir to accelerate development of production.

10 Claims, 1 Drawing Figure

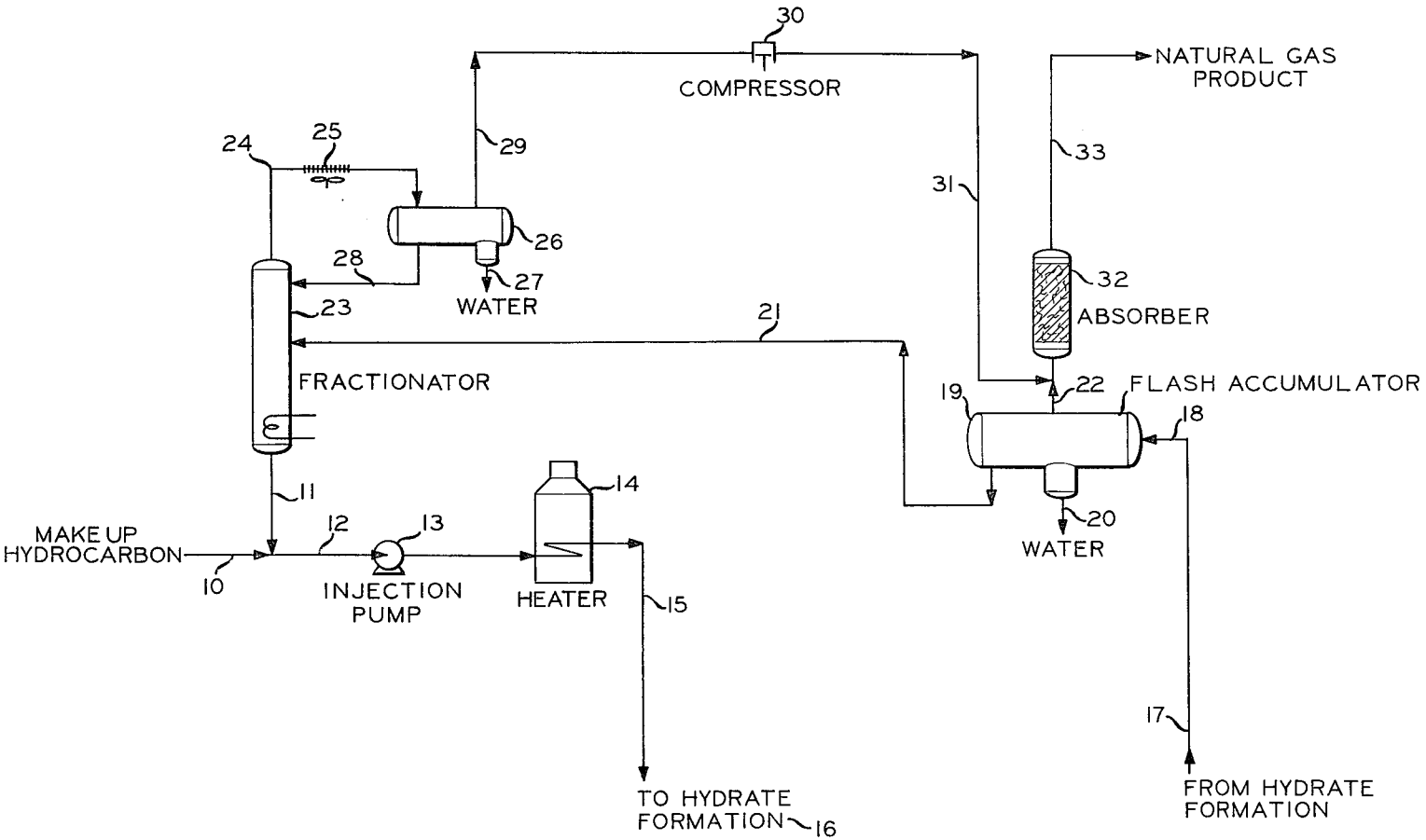
NATURAL GAS PRODUCT
33
32
ABSORBER
22
FLASH ACCUMULATOR
18
20
WATER
19
17
FROM HYDRATE FORMATION
31
30
COMPRESSOR
21
16
TO HYDRATE FORMATION
15
14
HEATER
29
26
27
WATER
13
INJECTION PUMP
25
28
23
FRACTIONATOR
12
11
24
10
MAKE UP HYDROCARBON

GAS RECOVERY FROM HYDRATE RESERVOIRS

This invention relates to the recovery of natural gas from hydrate reservoirs. In another aspect, this invention relates to the use of light hydrocarbons which do not form hydrates at reservoir conditions to dissolve and/or extract natural gas from the hydrate reservoir. In accordance with another aspect, this invention relates to a process for the recovery of natural gas from hydrate reservoirs by extraction with a normally liquid hydrocarbon either in the presence of or in the absence of a freezing point depressant and separation of the normally liquid hydrocarbon from the recovered natural gas and optionally recycling same to the reservoir. In accordance with a further aspect, a gas hydrate reservoir is subjected to hydraulic fracturing prior to injection of a light hydrocarbon to extract natural gas from a reservoir.

Although hydrates of natural gas have been known and studied for nearly a century, they were considered only a laboratory curiosity until the middle 1930's when their unwelcome presence was encountered in the production and transmission of high pressure natural gas. Since that time hydrates have been noted for their nuisance aspects — plugging lines and valves and fouling separators, fractionators and other equipment.

Hydrates are a group of molecular complexes sometimes referred to as clathrates or clathrate compounds. Many such complexes are known, involving a wide variety of organic compounds. They are characterized by a phenomenon "in which two or more components are associated without ordinary chemical union through complete enclosure of one set of molecules in a suitable structure formed by another" in the words of H. M. Powell (reference *J. Chem. Soc.* (London) 1948, 61). Gas hydrates may thus be regarded as solid solutions in which the hydrocarbon solute is held in the lattice of the solvent water.

In recent years it has been discovered that enormous reserves of natural gas underlie the permafrost areas of the world. Russian investigators have been particularly active in studying the scope of these reservoirs. They have estimated that gas reserves in the form of hydrate approximate 530 trillion cubic feet (15 trillion cubic meters) in the U.S.S.R. and about 1,780 trillion cubic feet (50 trillion cubic meters) for the world. Even these fabulous estimates may be conservative since they do not consider the possibility of the occurrence of similar reservoirs under the oceans in areas outside the permafrost region.

Six types of gas-water reservoirs are possible, four above ice temperature and two below;

Above Ice Temperature

Liquid water + Hydrate (Water in excess)
Gas + Hydrate (Hydrocarbon in excess)
Gas + Hydrate + Water (Low pressure reservoirs)
Gas + Water (Warm reservoirs)

Below Ice Temperature

Ice + Hydrate (Water in excess)
Gas + Hydrate (Hydrocarbon in excess)

Ice temperature would depend, of course, on the concentration of any dissolved salts in the water.

The Russians have suggested three methods for producing hydrate reservoirs: (1) reduce the pressure in the stratum to the value at which decomposition of the hydrate occurs at stratum temperature, (2) warm the deposit or part of it to a temperature at which the hydrate decomposes at stratum pressure, and (3) introduce catalyzers into the stratum to induce hydrate decomposition. Each of these methods has serious drawbacks. In the first method reservoir pressure would need to be immediately reduced — perhaps very substantially — to below hydrate decomposition pressure. Decomposition would lead to further reservoir cooling, requiring still further pressure reduction to maintain gas production. For example, in a methane hydrate reservoir a temperature drop of only 5° F (2.8° C) in the producing zone would require a corresponding pressure reduction of at least 300 psi (2.07 MPa) because of the lowered equilibrium pressure of methane hydrate. At 50° F (10° C) the equilibrium pressure for this hydrate is about 1080 psia (7.45 MPa); at 45° F (7° C) it drops to about 770 psia (5.30 MPa). Lower reservoir pressure is generally not desirable since it lowers the producibility of the formation and leads to increased production costs.

The second method suggested requires the injection of a considerable amount of heat — about 68,800 Btu/MCF (2.56 $MJ/m^3$) for methane hydrate. This would be rather expensive, particularly using the proposal of circulating hot brine.

The third suggested method involves the introduction of so-called "catalyzers" to the hydrate stratum. These "catalyzers" are merely freezing point depressants such as methanol. Russian investigators have tested this method with some success in that gas production rate was increased by an order of magnitude. This method would also be expensive, not only because of the cost of depressant but also because it would have the same shortcomings of the first method. The heat of hydrate decomposition requirement would still have to be met. This would be obtained through the reduction of reservoir temperature (and pressure) and tend to be self-defeating in that productivity of a well would decline rather rapidly to a level that could be supported by thermal conductivity through the reservoir.

Accordingly, an object of this invention is to provide a method for the recovery of gas from hydrate reservoirs.

Another object of this invention is to provide an economic process for producing natural gas from hydrate reservoirs.

Other objects, aspects, as well as the several advantages of the invention will be apparent to those skilled in the art on reading the specification and the appended claims.

Broadly, according to the invention, natural gas is recovered from hydrate reservoirs by dissolving and/or extracting the natural gas from the reservoir with a normally liquid hydrocarbon which does not form hydrates at reservoir conditions.

More specifically, according to the invention natural gas is recovered from a hydrate reservoir by passing light hydrocarbon through the reservoir to dissolve and/or extract the gases in a recycling type operation wherein the gas saturated liquid hydrocarbon is subjected to conditions at the surface which removes the natural gas and the denuded liquid hydrocarbon is returned to the reservoir for reuse.

In accordance with another embodiment, a freezing point depressant is also injected into the reservoir to speed development of production from the hydrate reservoir when subjected to treatment with light hydrocarbons which do not form hydrates at the reservoir conditions.

In accordance with a further embodiment, a gas hydrate reservoir is subjected to hydraulic fracturing to create channels and fissures in the reservoir prior to introduction of light hydrocarbon to dissolve and recover gas present in the reservoir.

This invention provides a more economical means for producing natural gas from hydrate reservoirs. It should be applicable to any of the five possible types of hydrate reservoirs, and offers several advantages over the previously proposed methods. It involves the injection into or adjacent to the hydrate stratum of normally liquid hydrocarbons which have little if any tendency to form hydrates at reservoir conditions. The injection of these hydrocarbons permits the extraction or dissolution of the hydrated natural gas components from the clathrate structure, leaving the water as ice or liquid water, depending on reservoir temperature. Thus the injected hydrocarbon, after circulation through the hydrate stratum, can be returned to the surface essentially saturated at reservoir conditions with the previously hydrated gas components. It then becomes a simple matter to remove the dissolved natural gas from the circulating hydrocarbon by flashing or distillation and recycling the denuded hydrocarbon liquid to the reservoir.

To minimize the amount of hydrocarbon fluid circulated, it is desirable to use the lowest molecular weight fluid possible. At the same time the fluid chosen is desirably one which does not hydrate at reservoir conditions. Pure propane does not hydrate at temperatures above about 42° F (5.6° C) and pure normal butane does not hydrate above about 34° F (1.1° C). Thus these hydrocarbons can be considered candidate fluids under appropriate reservoir conditions. They do have the disadvantage of forming ternary hydrates with methane and water at higher temperatures than those indicated for the pure components, however, so their use could entail some loss to the hydrate phase unless the hydrated reservoir gas already contained enough of those components to meet equilibrium requirements. In this fortunate circumstance the recovered reservoir gas could serve as the source of supply of injection hydrocarbon. In many cases a mixture of hydrocarbons such as propane and butanes can conveniently be used. The molecules of pentanes and heavier hydrocarbons are too large to enter the crystal lattice of hydrates, so they do not hydrate under any conditions and are therefore suitable injection fluids.

Thus, in accordance with the invention, saturated as well as unsaturated hydrocarbons which are liquid at reservoir conditions are used to dissolve and/or extract natural gas from gas hydrate reservoirs. Representative examples of presently preferred saturated hydrocarbons that can be used include propane, butane, pentane, hexane, cyclohexane, cyclooctane, decane, dodecane, and the like, and mixtures thereof. It is within the scope of the invention to use hydrocarbons, which are liquid at reservoir conditions, having from 3 to 12 carbon atoms per molecule represented by aliphatics, alicyclics, aromatics, and mixtures thereof.

The practice of this invention will greatly reduce the tendency for the reservoir to lose heat. The significance of this cooling will depend on the type of reservoir being produced. If the stratum temperature is at or below ice temperature, heat loss from the reservoir will be insignificant. The circulation of hydrocarbon fluid through such reservoirs causes the natural gas components to change from the clathrate phase to the liquid phase and the water to change from one crystalline phase (clathrate) to another (ice). The heat requirement for these phase changes is negligible. If stratum temperature is above ice temperature gas components move from the clathrate phase to the liquid hydrocarbon phase as before, but water is transformed from the clathrate phase to liquid water, absorbing its latent heat of fusion. Depending on hydrate composition, this heat of fusion will be equal to 60–70 percent of the heat of formation of the hydrate. If the reservoir contains a free gas phase, some of this vapor could dissolve in the liquid, releasing heat of solution which would help offset the heat absorbed by decomposing hydrate. Water released by hydrate decomposition could also recombine with reservoir gas to form new hydrate and thus release the heat of formation. This latter reaction is not too probable, however, since the low density gas would normally be isolated from the high density water by the intermediate density hydrocarbon liquid and gas hydrate.

If the permeability of the reservoir is too low to obtain satisfactory circulation of hydrocarbon through the hydrate formation, a freezing point depressant such as methanol or ammonia can be injected to hasten hydrate decomposition and help establish flow channels between injection and production wells. Perforation and hydraulic fracturing may desireably precede such injection. This procedure may be particularly helpful during the early development of a project and should be especially applicable to reservoirs which are below ice temperature and are composed of ice and hydrate or hydrate and only minor amounts of gas. The depressant can be injected as hydrocarbon or water solution or even as the pure material (liquid or vapor) as desired. The injected depressant can ultimately be recovered from the produced fluid by conventional means such as fractionation.

In addition to methanol and ammonia disclosed above as suitable freezing point depressants that can be used, other depressants that can be employed include other alcohols such as ethanol, propanol, and the like, glycols such as ethylene glycol and mixtures of such agents. Should the reservoir water be low in dissolved salt, the injection of brines may be helpful in decomposition of hydrate. The amount of freezing point depressant injected into the reservoir is dependent upon the reservoir conditions as well as the composition of the reservoir. The amount of freezing point depressant injected will be governed by heat and material balance considerations.

Where hydrocarbons are circulated to dissolve methane, for example, from the hydrate phase, the composition of the liquid hydrocarbon phase created by the injection can be readily estimated using vapor-liquid equilibrium constants from any well-known source (e.g., *Engineering Data Book*, Natural Gasoline Supply Men's Assn., Tulsa, OK). Vapor-solid equilibrium constants are also available for natural gas hydrates (e.g., *Handbook of Natural Gas Engineering*, Katz et al., McGraw-Hill, New York). Typically, a gallon of light hydrocarbon such as butane can dissolve 15–20 cubic feet of methane (96–130 $m^3$ methane per cubic meter of butane) from a hydrate reservoir.

Also, as indicated above, the reservoir can be subjected to hydraulic fracturing prior to injection of the normally liquid hydrocarbon into the reservoir. Suitable fracturing fluids that can be employed are any of those well known in the art which would be compatible with reservoir conditions. In particular, the fluid should preferably have a specific gravity in the 0.9–1.0 range to avoid creation of short-circuiting vertical channels as taught in U.S. Pat. No. 3,593,791, and the water phase of the fracturing fluid should be a brine containing sufficient dissolved salts to avoid freezing in the reservoir.

Fracturing fluids are generally emulsions composed of a mixture of an oil, water or brine, emulsifying agents and other additives plus a propping agent such as sand to prevent the resealing of fissures. Fluids particularly suited to hydrate reservoirs are those utilizing a high proportion of a volatile hydrocarbon such as butane in the oil phase. In this manner the volatile hydrocarbon selected could be one which also dissolves hydrates. Thus the fracturing fluid would have the additional favorable property of enlarging fissures by dissolution.

As hydrate is decomposed, channels will develop rapidly. This is brought about by two factors, removal of hydrated hydrocarbons and an increase in density of the water phase. Hydrate density is approximately 0.9, while the density of either water or ice is near 1.0.

A better understanding of the overall process of the invention as illustrated in one specific embodiment will be apparent upon reference to the accompanying drawing.

Referring now to the drawing, make-up hydrocarbon introduced by line 10 is mixed with recycle liquid hydrocarbon introduced by line 11 and the mixed stream is passed by way of line 12 through injection pump 13, heater 14, and thence into the underground gas hydrate reservoir by way of line 15. Heater 14 is optional as it is not necessary at times to heat the liquid hydrocarbon being introduced into the hydrate formation depending on whether it is desired to convert the hydrate crystals to water or leave as solids. The hydrocarbon stream passed through heater 14 is preferably heated sufficiently to convert hydrate to liquid. The temperature normally will be in the range of 100° F to 400° F (38° C to 204° C).

The liquid hydrocarbon, either heated or unheated in line 15 is injected through one or more injection wells into a hydrate formation 16. Although not shown in the drawing, the hydrate formation can be subjected to hydraulic fracturing prior to the injection of the hydrocarbon. The amount of hydrocarbon injected, and the temperature of the hydrocarbon injected, are sufficient to dissolve and/or extract natural gas present in the reservoir at the desired rate.

The liquid hydrocarbon solvent or extractant is forced through hydrate formation 16 and dissolves gas present therein and is removed from the reservoir with dissolved gases by way of production well or line 17 and passed by conduit 18 to flash accumulator 19 wherein the hydrocarbon mixture containing dissolved gases is subjected to conditions of temperature and pressure such that water is separated by way of line 20, liquid hydrocarbon by way of line 21, and vapor by way of line 22.

The liquid hydrocarbon extractant in line 21 is passed to fractionator 23 wherein it is subjected to fractionation conditions to remove overhead nautural gas by line 24 and liquid hydrocarbon by way of line 11 for recycle and reinjection into the hydrate reservoir.

The overhead from fractionator 23 in line 24 is cooled by heat exchanger 25 and passed to accumulator 26 wherein water is removed as bottoms by way of line 27 and hydrocarbon condensate is returned to fractionator 23 as reflux by line 28. Natural gas is removed overhead from accumulator 26 by line 29 and passed to compressor 30 and thence by line 31 and is mixed with overhead from flash accumulator 19 and the mixed stream is introduced into adsorber 32. The mixed stream is passed through adsorber 32 containing a suitable adsorbent material to remove residual amounts of liquid hydrocarbon prior to recovery of natural gas produced through line 33.

Although not shown in the drawing, the high pressure produced fluid can be passed to a power recovery turbine for energy recovery. This power could conveniently be used to provide part of the injection pump power requirements. Also not shown in the drawing are means for regeneration of the adsorber 32 which can be any conventional method such as, for example, by heating.

EXAMPLE

A hydrate reservoir which is substantially methane hydrate, $CH_4 \cdot 7H_2O$, has a small methane gas cap and underlying water. The reservoir is at 50° F (10° C) and 1080 PSIA (7.45 MPa). Several injection and production wells are suitably located to allow circulation of liquid hydrocarbon through the reservoir, said liquid passing either through the hydrate layer or adjacent to it at the hydrate-water interface. Normal butane is injected into the reservoir at a high rate, about 1500–2000 GPM (0.095–0.126 $m^3/s$) to build up an inventory of butane-methane solution and to provide some excess butane for entering the hydrate phase. At lined-out conditions butane is circulated at 910 GPM (0.0575 $m^3/s$) to dissolve the equivalent of 24 MMSCFD (million standard cubic feet per day) (7.86 $m^3/s$) of methane. Since the dissolution process in this case releases about 7.9 pounds (Kg) of liquid water for each pound (Kg) of methane dissolved, the process results in the absorption of about 48,000 BTU for each 1000 cubic feet (1.8 $MJ/m^3$) of methane dissolved. To partially offset this tendency for the reservoir to cool, the butane is injected at 250° F (121° C), sufficient to supply about three-fourths of the heat of decomposition of the hydrate.

The produced butane with dissolved methane is flashed at 600 PSIA (4.82 MPa) in a flash accumulator where free water is also withdrawn. The hydrocarbon phase then passes to a fractionator operating at 350 PSIA (2.41 MPa). Methane vapor overhead product from the fractionator is compressed to 600 PSIA (4.82 MPa), combined with the methane from the accumulator flash and passed through a charcoal adsorption unit to recover additional butane before passing to a pipeline. The butane bottom product from the fractionator is at about 250° F (121° C) and is pumped for reinjection to the reservoir without further heat exchange.

I claim:

1. A process for recovering natural gas from a subterranean gas hydrate reservoir which comprises:

a. injecting into or adjacent to the hydrate stratum of the reservoir at least one hydrocarbon which is liquid at reservoir conditions and which has little if any tendency to form hydrates at reservoir conditions and which is injected under conditions sufficient to force said hydrocarbon into the reservoir and extract and/or dissolve hydrate gas components from the clathrate structure and leaving water as ice or cold liquid, and b. returning said hydrocarbon containing dissolved gases to the surface essentially saturated at reservoir conditions with the previously hydrate gas components.

2. A process according to claim 1 wherein said hydrocarbon containing dissolved gases returned to the surface is separated from the dissolved natural gases and the denuded hydrocarbon liquid is recycled and reinjected into the reservoir.

3. A process according to claim 1 wherein a fracturing fluid is first introduced into the said reservoir under sufficient pressure to fracture the reservoir and provide channels or fissures therein for ease of flow of said hydrocarbon subsequently injected into the reservoir.

4. A process according to claim 1 wherein said hydrocarbon is heated sufficiently prior to introduction into the reservoir to convert hydrate water present to liquid water.

5. A process according to claim 1 wherein said hydrocarbon injected into the stratum is selected from aliphatic, alicyclic, and aromatic hydrocarbons having from 3–12 carbon atoms, and mixtures thereof.

6. A process according to claim 5, wherein said hydrocarbon is selected from propane, butane, pentane, hexane, and mixtures thereof and there is also injected into the reservoir a freezing point depressant selected from methanol and ammonia.

7. A process according to claim 1 wherein a freezing point depressant is injected into the reservoir to assist hydrate decomposition and establish flow channels between the input and withdrawal points of the reservoir.

8. A process according to claim 7 wherein said freezing point depressant is methanol or ammonia.

9. A process according to claim 7, wherein said hydrocarbon and said freezing point depressant are injected together into the formation and both are separated at the surface from the recovered natural gas dissolved in said hydrocarbon and both are recycled and reinjected into the reservoir for reuse.

10. A process according to claim 7, wherein said liquid hydrocarbon and said freezing point depressant are injected through one or more injection wells penetrating said reservoir and liquid hydrocarbon containing dissolved natural gas is produced through one or more production wells penetrating said reservoir and spaced from said injection wells.

* * * * *